US007108551B2

(12) United States Patent
Nishide

(10) Patent No.: US 7,108,551 B2
(45) **Date of Patent: *Sep. 19, 2006**

(54) DIVIDED CONNECTOR AND A METHOD OF ASSEMBLING IT

(75) Inventor: Satoru Nishide, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/977,668

(22) Filed: Oct. 29, 2004

(65) Prior Publication Data

US 2005/0095876 A1 May 5, 2005

(30) Foreign Application Priority Data

Oct. 29, 2003 (JP) ..... 2003-368916

(51) Int. Cl.
*H01R 13/40* (2006.01)

(52) U.S. Cl. ..... 439/595

(58) Field of Classification Search ..... 439/595, 439/596, 752, 701, 686, 598
See application file for complete search history.

(56) References Cited

U.S. PATENT DOCUMENTS 4,682,839 A * 7/1987 Bryce ..... 439/598
5,957,732 A * 9/1999 Ito et al. ..... 439/752
6,375,504 B1 4/2002 Ito et al.
6,582,256 B1 * 6/2003 Sakurai et al. ..... 439/701
6,638,108 B1 * 10/2003 Tachi ..... 439/595
6,749,469 B1 * 6/2004 Matsuoka ..... 439/752
6,764,352 B1 * 7/2004 Tsuji ..... 439/752
6,939,163 B1 * 9/2005 Fujita ..... 439/381
6,976,875 B1 * 12/2005 Nishide ..... 439/598
2002/0106942 A1 * 8/2002 Sakurai et al. ..... 439/701
2002/0151202 A1 10/2002 Tachi et al.
2002/0173198 A1 11/2002 Plate
2003/0143891 A1 7/2003 Tanaka et al.
2004/0077230 A1 * 4/2004 Nakano ..... 439/752
2004/0092173 A1 * 5/2004 Nakamura et al. ..... 439/752
2004/0242084 A1 * 12/2004 Fujita ..... 439/752
2005/0095921 A1 * 5/2005 Nishide ..... 439/701
2005/0170704 A1 * 8/2005 Ishikawa et al. ..... 439/752

FOREIGN PATENT DOCUMENTS

JP 2000-331738 11/2000

* cited by examiner

*Primary Examiner*—Garry F. Paumen
*Assistant Examiner*—Larisa Tsukerman
(74) *Attorney, Agent, or Firm*—Gerald E. Hespos; Anthony J. Casella

(57) ABSTRACT

Error insertion preventing ribs (37) fittable into error insertion preventing grooves (23) of an accommodating portion (12) of a housing main body (11) project on the side surfaces of an auxiliary connector (30), and detecting ribs (43) insertable into error insertion preventing grooves (23) are provided on retainers (40). In the case that the auxiliary connector (30) is insufficiently inserted, the error insertion preventing ribs (37) of the auxiliary connector (30) interfere with the detecting ribs (43) of the retainers (40) in the process of mounting the retainers (40) to restricting positions to prevent the mounting of the retainers (40). In this way, the insufficiently inserted state of the auxiliary connector (30) can be detected.

12 Claims, 15 Drawing Sheets

DIVIDED CONNECTOR AND A METHOD OF ASSEMBLING IT

BACKGROUND OF THE INVENTION

1. Field of the Invention

The invention relates to a divided connector.

2. Description of the Related Art

Japanese Unexamined Patent Publication No. 2000-331738 shows a divided connector with a housing main body and a separate auxiliary housing in an accommodating portion of the housing main body. Cavities are provided in the housing main body and in the auxiliary housing for accommodating terminal fittings. The divided connector is intended to achieve efficiencies during insertion of the terminal fittings.

The auxiliary housing of the divided connector may inadvertently be left insufficiently inserted during an assembly. Many prior art divided connectors have no means for detecting the insufficient insertion of the auxiliary housing. Other prior art divided connectors detect insufficient insertion with a detector that is added to a conventional construction, thereby leading to an increased number of parts and higher production costs.

The invention was developed in view of the above problem and an object thereof is to detect an insufficiently inserted state of an auxiliary connector housing without increasing the number of parts of a divided connector.

SUMMARY OF THE INVENTION

The invention relates to a divided connector with a housing main body that has one or more cavities and an accommodating portion. Terminal fittings are mountable into the cavities of the housing main body. The divided connector also includes an auxiliary housing with one or more cavities for receiving terminal fittings. The auxiliary housing is fittable into the accommodating portion. The divided connector further includes a retainer to be mounted at a restricting position in the housing main body to lock the terminal fittings in the housing main body. The auxiliary housing does not interfere with the retainer and permits the retainer to be mounted at the restricting position if the auxiliary housing is at a proper mount position in the housing main body. However, the auxiliary housing interferes with the retainer and prevents the retainer from being mounted to the restricting position if the auxiliary housing is displaced back from the proper mount position. Thus, the insufficiently inserted state of the auxiliary housing can be detected. The retainer is an existing structure, and therefore the insufficiently inserted state of the auxiliary housing can be detected without increasing the number of parts.

At least one error insertion-preventing rib preferably is provided on an outer surface of the auxiliary housing and at least one error insertion-preventing groove is formed in an inner surface of the accommodating portion for receiving the error insertion preventing rib. The retainer preferably has at least one detector that is insertable into the error insertion-preventing groove in the process of mounting the retainer. The error insertion-preventing rib of the auxiliary housing does not interfere with the detector and permits the retainer to be mounted at the restricting position when the auxiliary housing is at a proper mount position. However, the error insertion-preventing rib interferes with the detector and prevents the retainer from being mounted to the restricting position when the auxiliary housing is displaced back from the proper mount position. Thus, insufficient insertion of the auxiliary housing can be detected. The error insertion-preventing rib and the detector are existing structures, and it is not necessary to make a complex design change.

The housing main body and the retainer preferably fit in a fitting portion of a mating connector. Error connection-preventing ribs and grooves preferably are provided on outer surfaces of the retainer and on the inner surface the fitting portion. The error connection-preventing rib fits in the groove when the retainer is at the restricting position in the housing main body. However, the error connection-preventing rib interferes with the fitting portion and prevents the connector from being connected with the mating connector if the retainer is not at the restricting position. In this way, an incompletely mounted retainer can be detected.

The terminal fittings in the auxiliary connector preferably are spaced apart along the connecting direction from the terminal fittings mounted in the housing main body.

The retainer preferably is integral or unitary with the housing main body.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
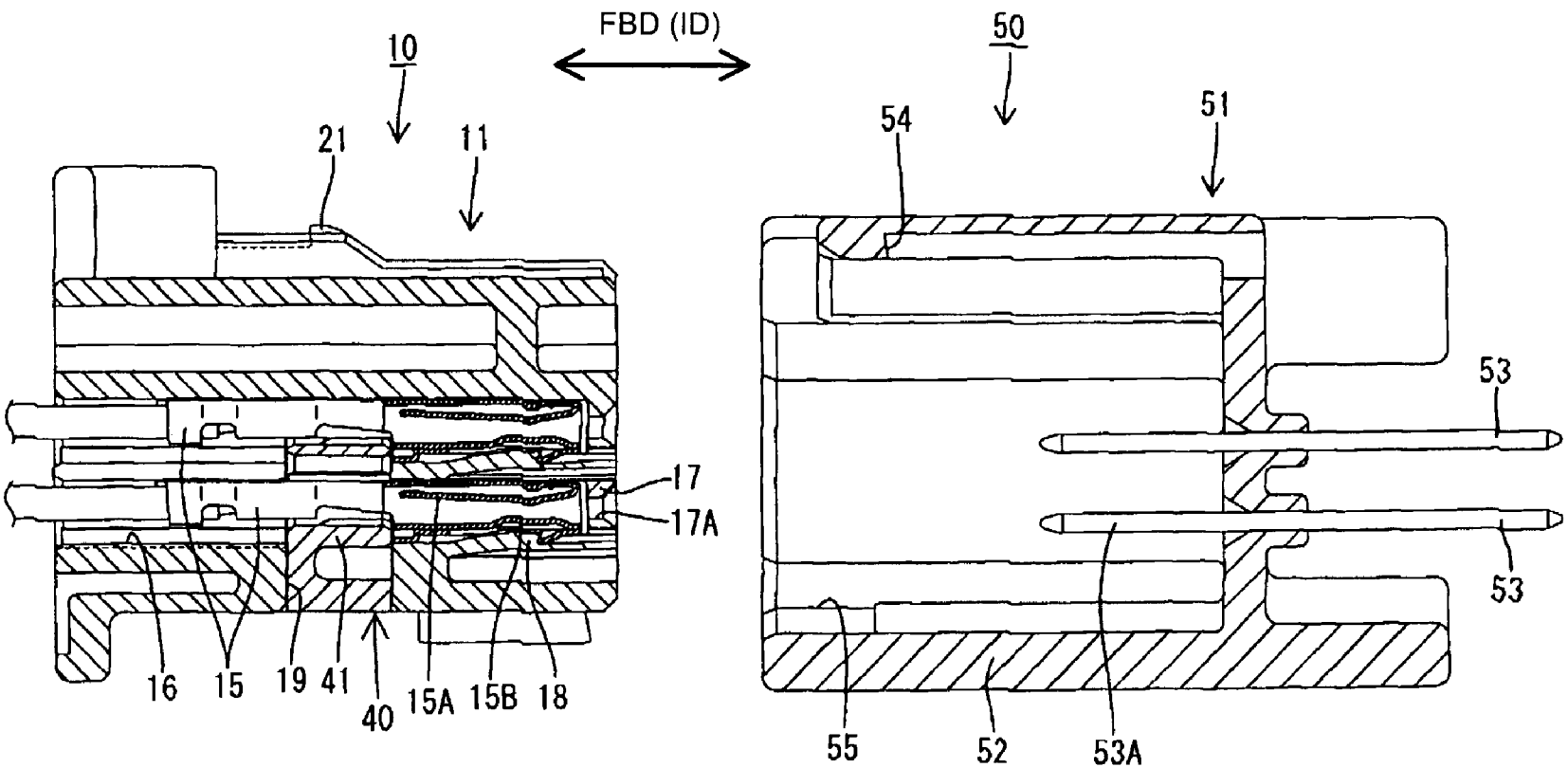
FIG. 1 is a side view in section showing a state before male and female connectors are connected in one embodiment of the invention.

A female divided connector according to the invention is identified generally by the numeral 10 in FIGS. 1 to 15. The divided connector 10 includes a housing main body 11, at least one auxiliary connector 30 to be accommodated in the housing main body 11, and two retainers 40 to be mounted into a lower part of the housing main body 11. The divided connector 10 is connectable with a male connector 50. In the following description, ends of the male and female connectors 50, 10 to be connected with each other are referred to as the front. Additionally, the terms upper and lower are provided as a convenient frame of reference, but are not intended to imply a required gravitational frame orientation.

Figure 2:
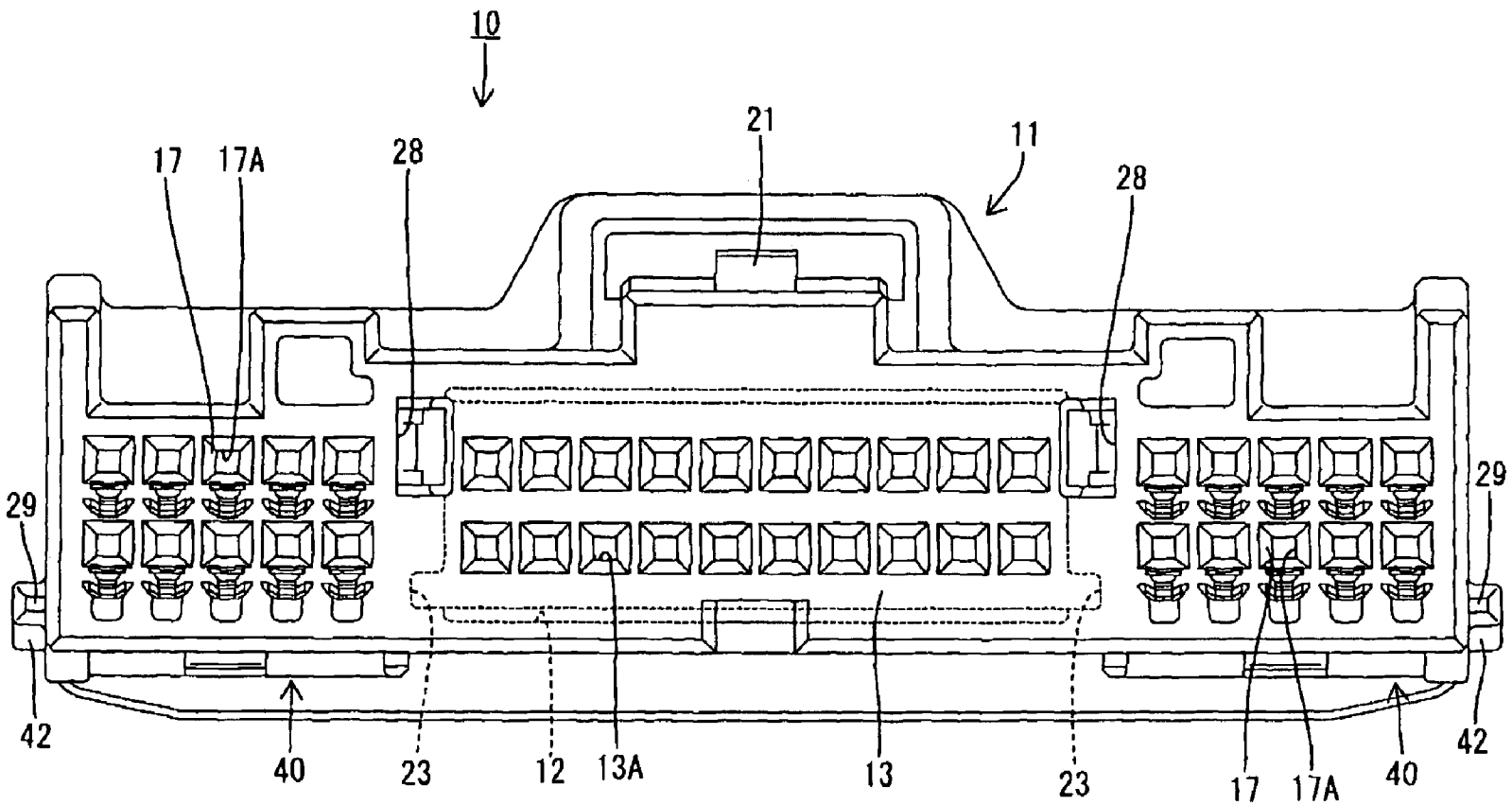
FIG. 2 is a front view of a housing main body.
Figure 3:
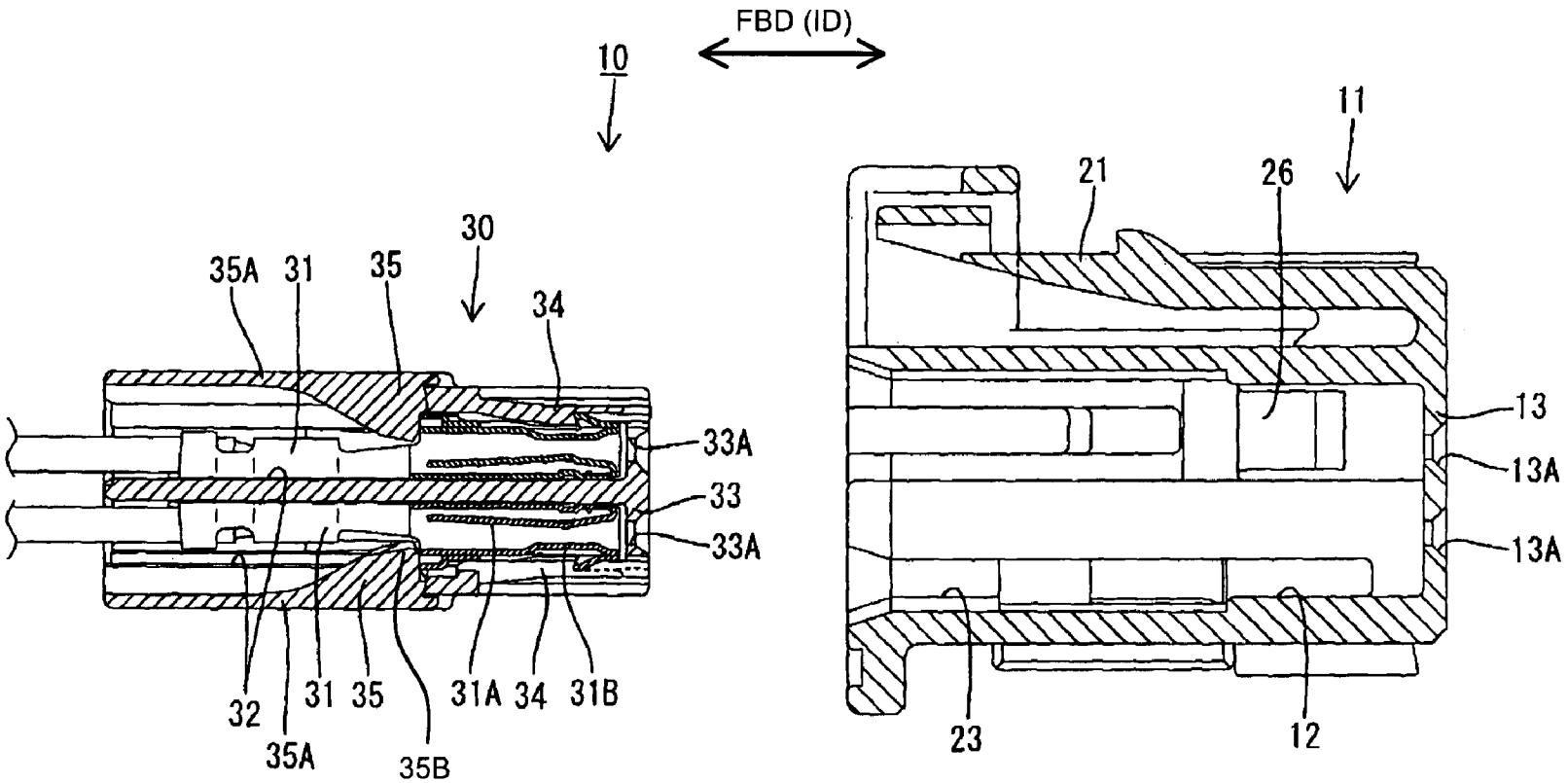
FIG. 3 is a side view in section showing a state before an auxiliary connector is assembled into the housing main body.
Figure 4:
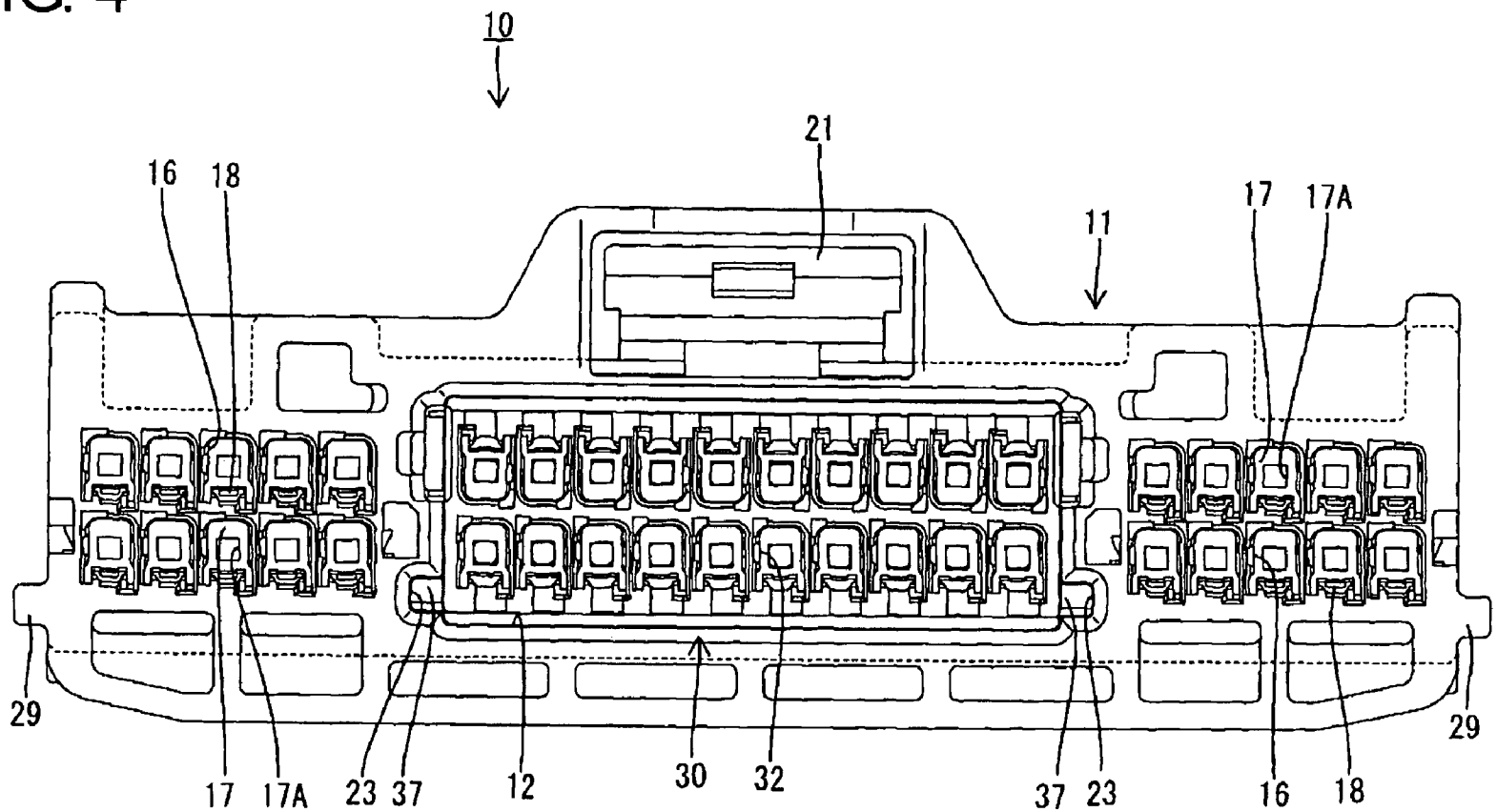
FIG. 4 is a rear view of the female connector.

The housing main body 11 is made e.g. of a synthetic resin and is in the form of a wide box. An accommodating portion 12 is formed in a widthwise intermediate portion of the housing main body 11 and has an open rear end, as shown in FIGS. 2 to 4. The auxiliary connector 30 can be inserted into the accommodating portion 12 in an insertion direction ID. A front wall 13 extends across the front surface of the accommodating portion 12 for stopping the auxiliary connector 30 at its front-end position, and tab insertion holes 13A penetrate the front wall 13 at positions corresponding to cavities 32 of the auxiliary connector 30. Cavities 16 are arranged in the housing main body 11 in arrays disposed symmetrically at opposite sides of the accommodating portion 12. Each array of cavities 16 has upper and lower stages. Female terminal fittings 15 are inserted into the cavities 16. Each female terminal fitting 15 has a resilient contact 15A at its front, and is electrically connectable with a male terminal fitting 53. More particularly, a tab 53A of the male terminal fitting 53 is insertable into a space between the resilient contact 15A and a receiving portion 15B that projects from the surface facing the resilient contact 15A. A front wall 17 is provided at the front end of each cavity 16 for stopping the female terminal fitting 15 at its front-end position, and a tab insertion hole 17A penetrates the front wall 17. The front walls 17 of the cavities 16 and the front wall 13 of the accommodating portion 12 substantially align at the front surface of the housing main body 11. However, the front walls 17 of the cavities 16 are slightly thicker than the front wall 13 of the housing main body (see FIG. 13). A lock 18 is provided on the bottom surface of each cavity 16 near the front end and is supported at both front and rear ends. The lock 18 is vertically resiliently deformable and engages the inserted female terminal fitting 15 for primary locking. Two retainer mount holes 19 are formed in the lower part of the housing main body 11 at positions corresponding to the groups of the cavities 16 and near middle portions with respect to forward and backward directions FBD (see FIG. 1). The retainers 40 are mounted from below into the retainer mount holes 19 in a direction intersecting the forward and backward directions FBD, preferably substantially normal thereto. Further, a vertically resiliently deformable lock arm 21 is cantilevered from a transverse intermediate position of the upper surface of the housing main body 11.

Figure 5:
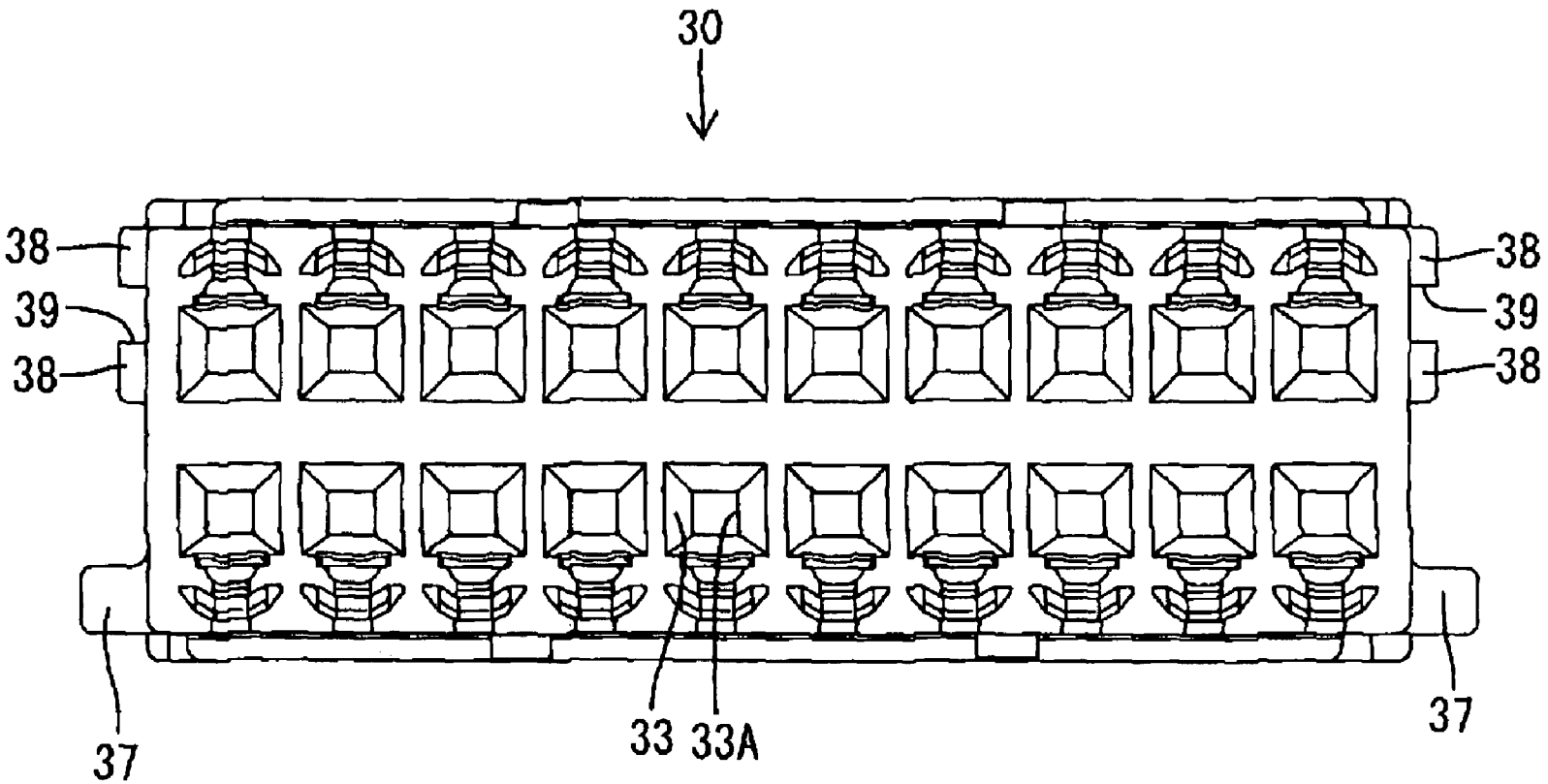
FIG. 5 is a front view of the auxiliary connector.

The auxiliary connector 30 is made e.g. of a synthetic resin and is in the form of a wide box that can be inserted from behind into the accommodating portion 12 of the housing main body 11, as shown in FIGS. 3 to 5. Cavities 32 are formed at upper and lower stages in the auxiliary connector 30 for receiving female terminal fittings 31. A resilient contact 31A is formed at the front of each female terminal fitting 31 and a receiving portion 31B projects from a surface facing the resilient contact 31A. A tab 53A of the male terminal fitting 53 can be received in a space between the resilient contact 31A and the receiving portion 31B to connect the female terminal fitting 31 electrically with the male terminal fitting 53. The female terminal fittings 31 are of the same kind as the female terminal fittings 15, and the number of female terminal fittings 15 equals the number of female terminal fittings 31. A front wall 33 is provided at the front end of each cavity 32 for stopping the female terminal fitting 31 at a front-end position, and tab insertion holes 33A penetrate the front wall 33 into the cavities 32. A resiliently deformable lock 34 is provided near the front of each cavity 32 and engages the inserted female terminal fitting 31 for primary locking. Retainers 35 are provided unitarily on the upper and lower surfaces of the auxiliary connector 30 via thin hinges 35A (see also FIG. 9) and can be opened and closed. The female terminal fittings 31 can be inserted in and withdrawn from the cavities 32 when the retainers 35 are opened. However, engaging projections 35B of the retainers 35 enter the cavities 32 (FIG. 3) to engage the female terminal fittings 31 when the retainers 35 are closed to lock the terminal fittings secondarily.

Figure 13:
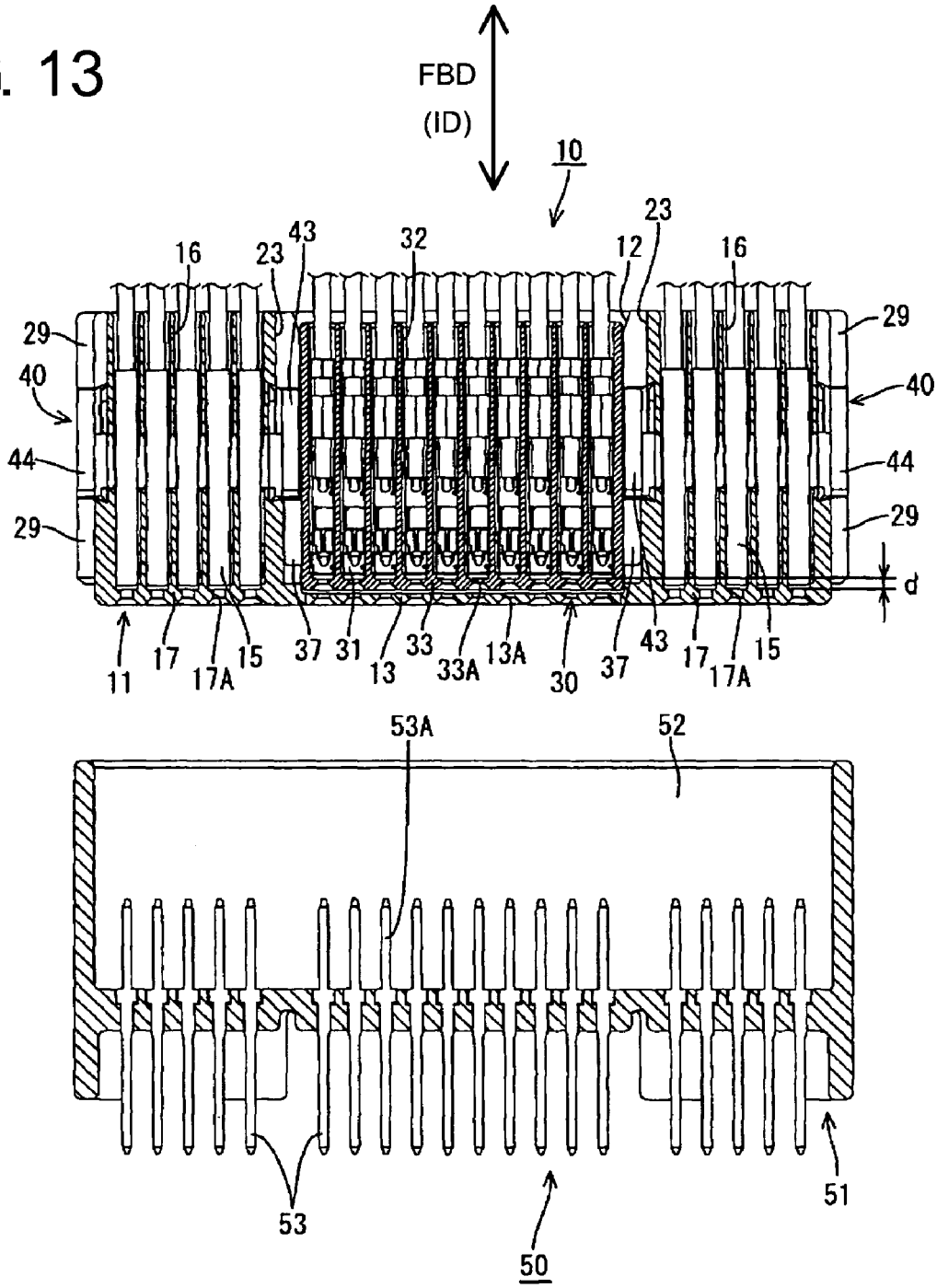
FIG. 13 is a plan view in section showing a state before the male and female connectors are connected.
Figure 14:
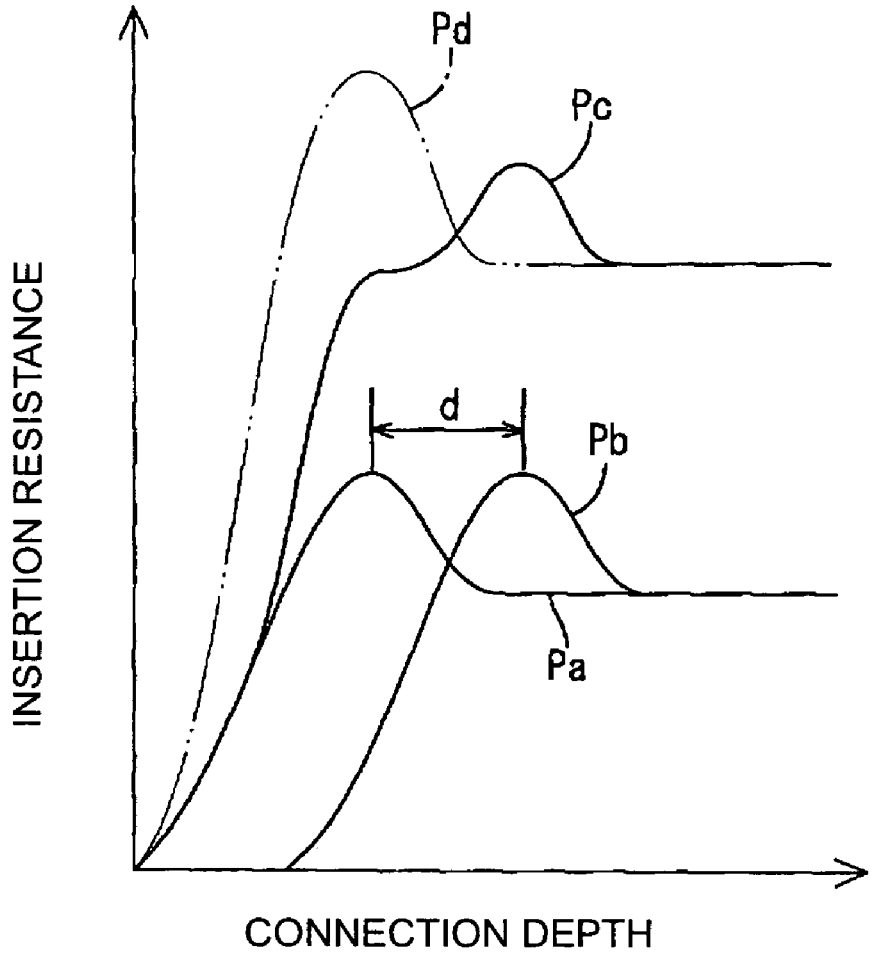
FIG. 14 is a graph showing transitions of insertion resistances created between male and female terminal fittings.

A sum of the thicknesses along the forward and backward directions FBD of the front wall of the accommodating portion 12 and the front wall 33 of each cavity 32 in the auxiliary connector 30 exceeds the thickness of the front walls 17 of the cavities 16 in the housing main body 11 by a dimension d (see e.g. FIG. 13). Thus, the female terminal fittings 31 in the cavities 32 of the auxiliary connector 30 are displaced along the forward and backward directions FBD from the female terminal fittings 15 in the housing main body 11 by the dimension d when the auxiliary connector 30 is inserted to a proper mount position where the front wall 33 of the auxiliary connector 30 contacts the front wall 13 of the accommodating portion 12, as shown in FIG. 13.

Figure 6A:
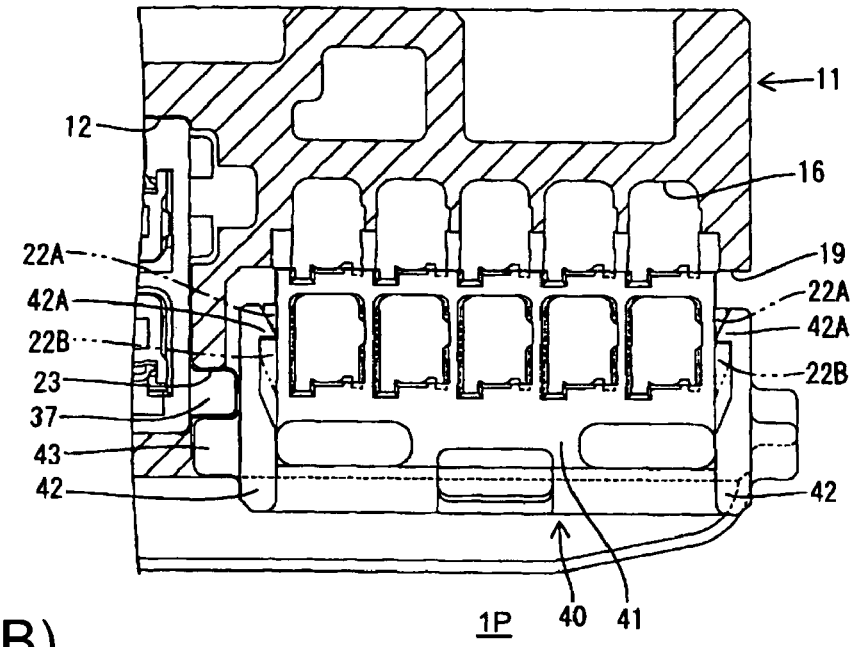
FIGS. 6(A) and 6(B) are partial enlarged sections showing a state where a retainer is mounted at a partial locking position and a state where the retainer is mounted at a full locking position, respectively.
Figure 6B:
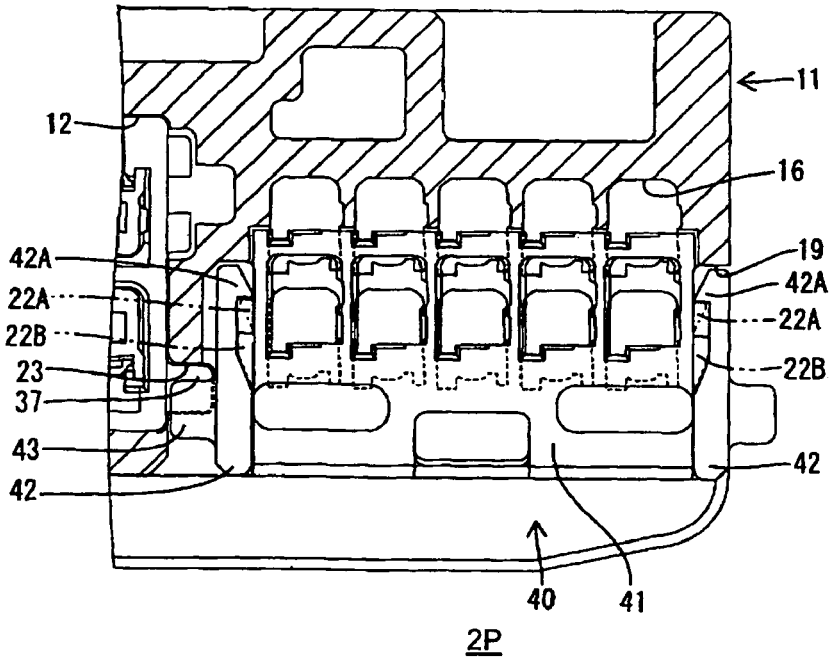
Figure 7:
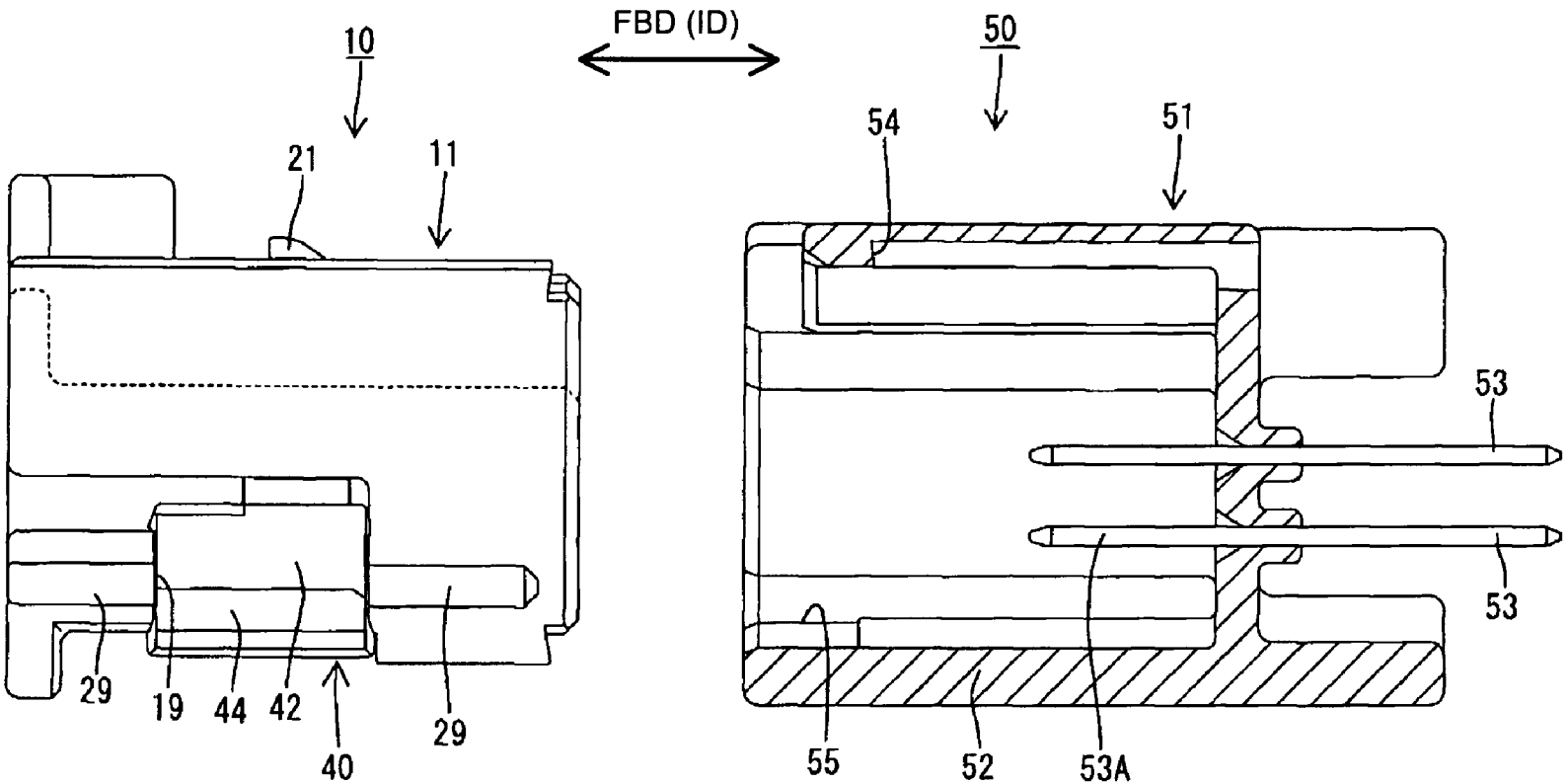
FIG. 7 is a side view in section of the male and female connectors when the retainer is located at the partial locking position.

Each retainer 40 is made e.g. of a synthetic resin and has a lattice-shaped main body 41. Plate-shaped sidewalls 42 extend from opposite left and right edges of the main body 41 along forward and backward directions FBD, as shown in FIGS. 1, 6 and 7. The retainer 40 can be held at a partial locking position 1P having a short depth of insertion (see FIG. 6(A)) and a full locking position 2P having a long depth of insertion (see FIG. 6(B)) by engaging locking claws 42A at the inner surfaces of the upper ends of the side walls 42 with locking projections 22A, 22B on the surfaces of the housing main body 11 facing the retainer mount hole 19. The main body 41 of the retainer 40 is retracted from the cavities 16 to permit insertion and withdrawal of the female terminal fittings 15 at the partial locking position 1P. However, the main body 41 enters the cavities 16 to lock the female terminal fittings 15 and to prevent the female terminal fittings 15 from coming out at the full locking position 2P.

Figure 8A:
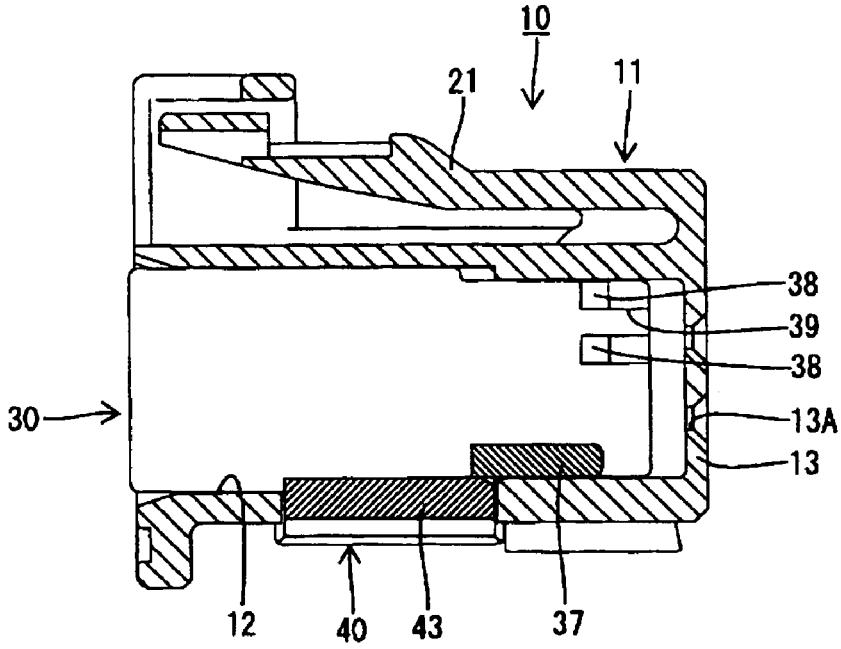
FIGS. 8(A) and 8(B) are side views in section showing a state where a movement of the retainer by pushing is prevented and a state where the retainer is pushed to the full locking position.
Figure 8B:
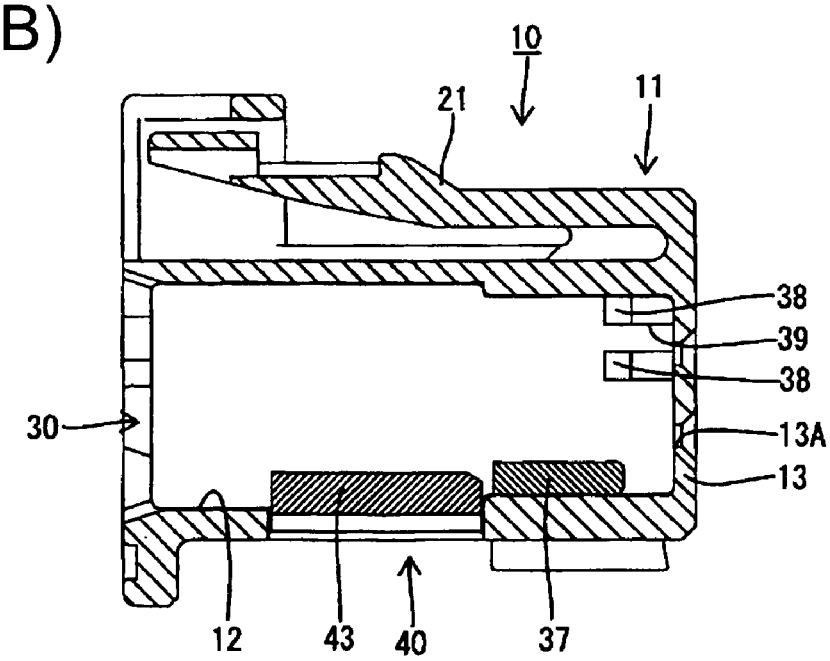

Error insertion preventing ribs 37 project near the front end at each of the left and right surfaces of the auxiliary connector 30 and extend parallel to the forward and backward directions FBD (see e.g. FIGS. 7 and 8). Error preventing grooves 23 extend along forward and backward directions FBD at the bottom of the inner side surfaces of the accommodating portion 12 in the housing main body 11 (see FIG. 4) and receive the error insertion preventing ribs 37. The error insertion preventing ribs 37 and the error insertion preventing grooves 23 prevent upside-down insertion of the auxiliary connector 30. Detecting ribs 43 project at a bottom part of the outer surface of the side wall 42 of each retainer 40 closer to the accommodating portion 12 (see FIGS. 6 and 8) and extend along forward and backward directions FBD. The detecting ribs 43 enter the error insertion preventing grooves 23 of the accommodating portion 12 in the housing main body 11 when the retainer 40 is at the full locking position 2P (see FIG. 6(B)), but are retracted from them when the retainer 40 is at the partial locking position 1P (see FIG. 6(A)). The error insertion preventing ribs 37 of the auxiliary connector 30 do not interfere with the detecting ribs 43 of the retainer 40 when the auxiliary connector 30 is at the proper mount position (see FIG. 8(B)). Thus, the retainer 40 can move from the partial locking position 1P to the full locking position 2P. However, the error insertion preventing ribs 37 interfere with the detecting ribs 43 when the auxiliary housing 30 is displaced back from the proper mount position. Thus, the retainer 40 cannot be pushed to the full locking position 2P (see FIG. 8(A)).

Figure 9:
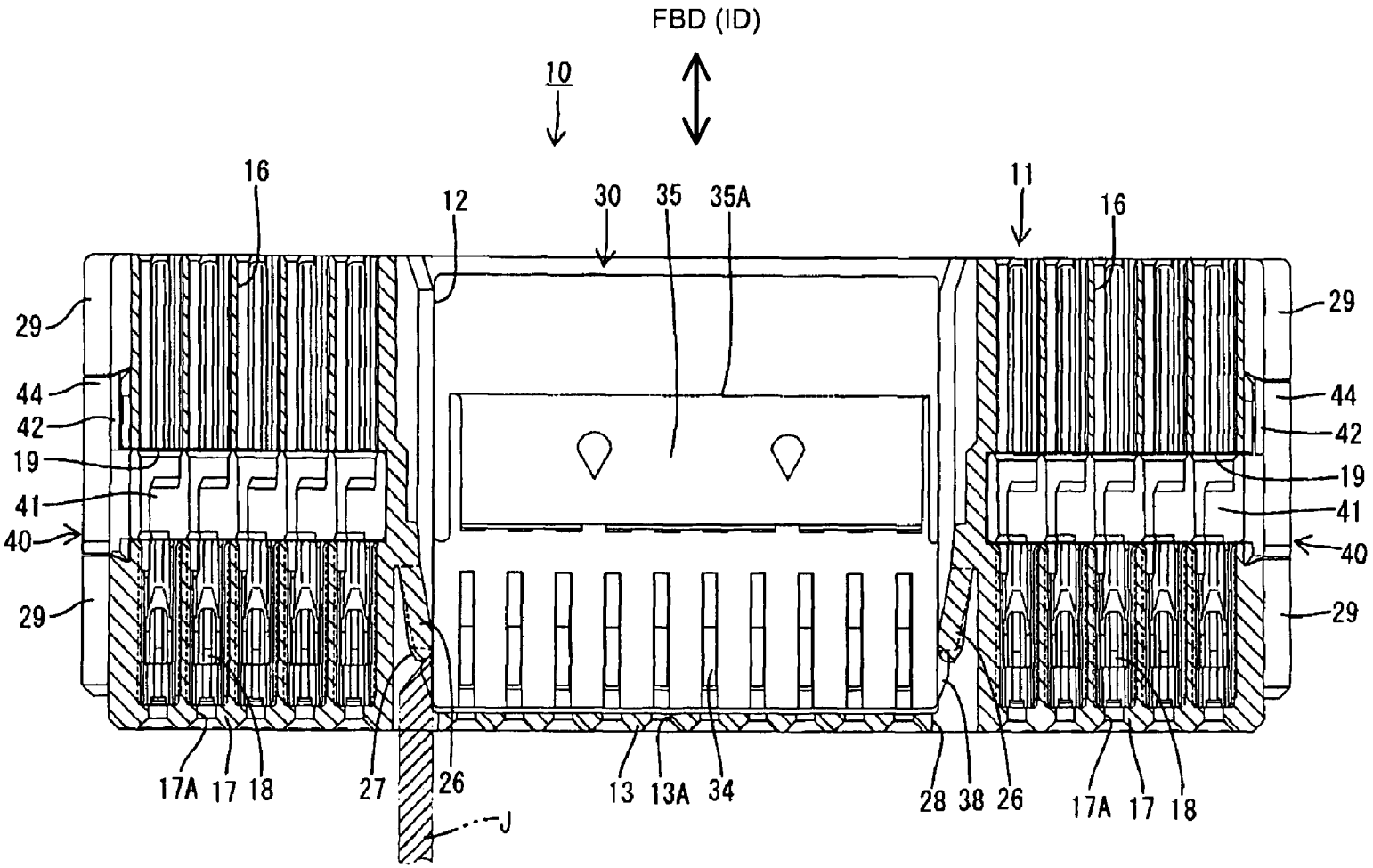
FIG. 9 is a plan view in section showing a state where a jig for unlocking the auxiliary connector is inserted.
Figure 10:
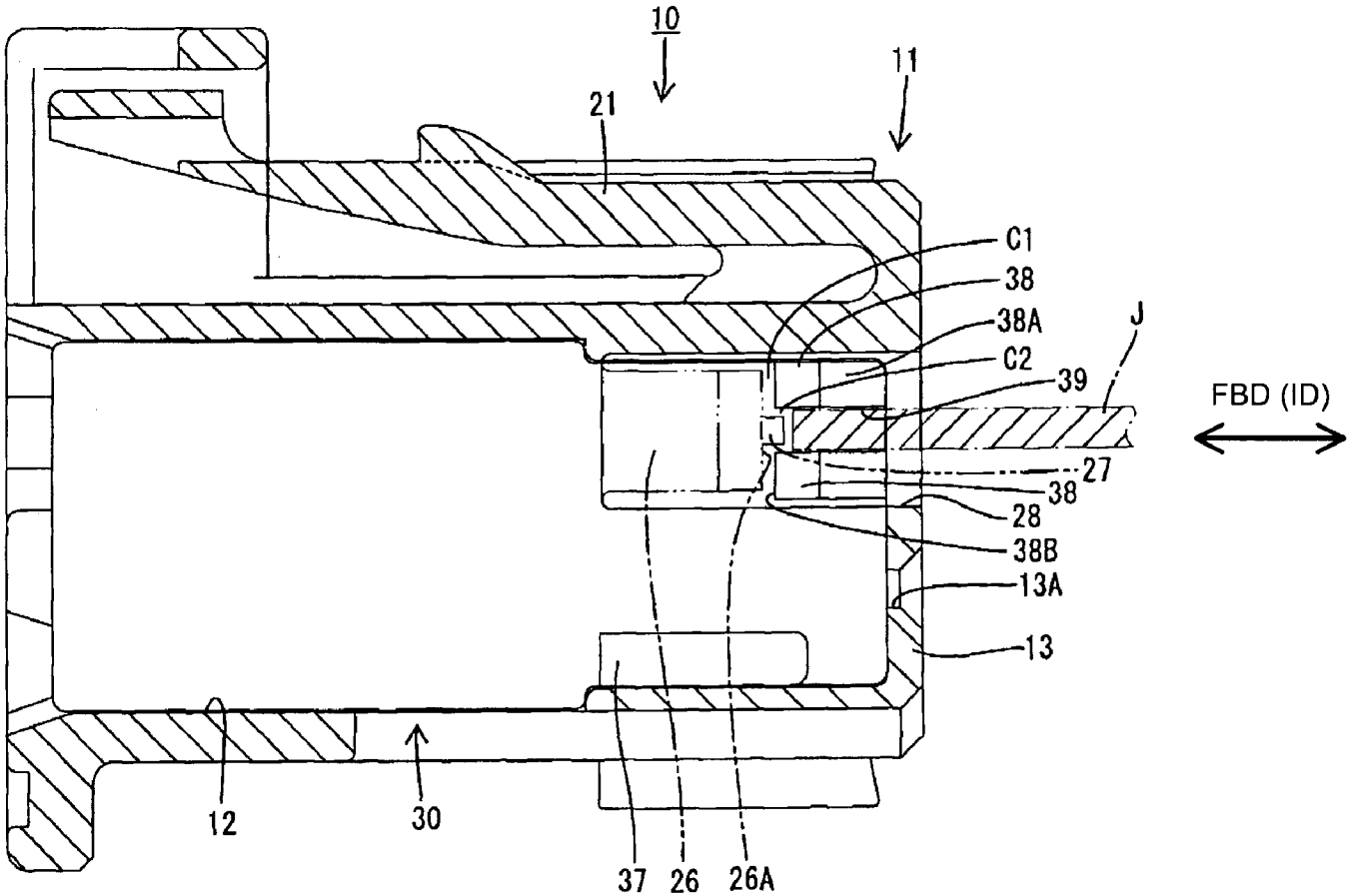
FIG. 10 is a side view in section showing a state where the jig for unlocking the auxiliary connector is inserted.

As shown in FIGS. 9 to 11, resiliently deformable plate-shaped locks 26 extend obliquely in toward the front at upper parts of the inner left and right surfaces of the accommodating portion 12 of the housing main body 11. Each lock 26 is transversely deformable away from the auxiliary housing 30. A locking surface 26A is formed at the leading end of the lock 26 and is inclined in towards the front with respect to an insertion direction ID of the auxiliary housing 30 into the accommodating portion 12.

Vertically spaced upper and lower locking projections 38 are formed at the front upper end of each of the opposite side surfaces of the auxiliary connector 30 and a groove 39 extends forward and backward therebetween. A moderately sloped guiding surface 38A is formed at the front of each locking projection 38, and an undercut locking surface 38B is at the rear surface thereof. The locking surface 26A of the lock 26 is engageable with the locking surface 38B. A disengaging projection 27 projects substantially in the vertical middle of the locking surface 26A of each lock 26. The disengaging projection 27 enters a clearance between the upper and lower locking projections 38 when the locking surface 26A engages the locking surfaces 38B of the locking projections 38. An introducing surface 27A is formed on the disengaging projection 27A and is rounded convexly towards the accommodating portion 12. The lock 26 can be deformed resiliently in unlocking direction ULD intersecting the forward and backward directions FBD by inserting the leading end of a jig J into a clearance between the introducing surface 27A and the side surface of the auxiliary connector 30 while the lock 26 is engaged with the locking projections 38. Unlocking windows 28 are formed in the front wall 13 of the housing main body 11 at positions before the locks 26 for receiving the jig J. As shown in FIG. 10, the lock 26 and the locking projections 38 are spaced apart along forward and backward directions FBD and a direction substantially normal thereto. Thus, specified clearances C1, C2 are defined and are set to be larger than a clearance between the auxiliary connector 30 and the inner wall of the accommodating portion 12.

As shown in FIG. 7, error connection preventing ribs 29 project substantially along a connecting direction of the female connector 10 with the male connector 50 on lower parts of substantially opposite left and right surfaces of the housing main body 11. Each error connection preventing rib 29 has front and rear sections at opposite sides of the retainer mount hole 19. On the other hand, error connection preventing ribs 44 extend substantially along forward and backward directions FBD on the outer surfaces of the outer side walls 42 of the respective retainers 40. The error connection preventing ribs 44 align with the error connection preventing ribs 29 of the housing main body 11 substantially along the connecting direction when the retainer 40 is at the full locking position 2P. However, the error connection preventing ribs 44 are displaced down substantially normal to the forward and backward directions FBD from the error connection preventing ribs 29 of the housing main body 11 when the retainer 40 is at the partial locking position 1P.

Figure 12:
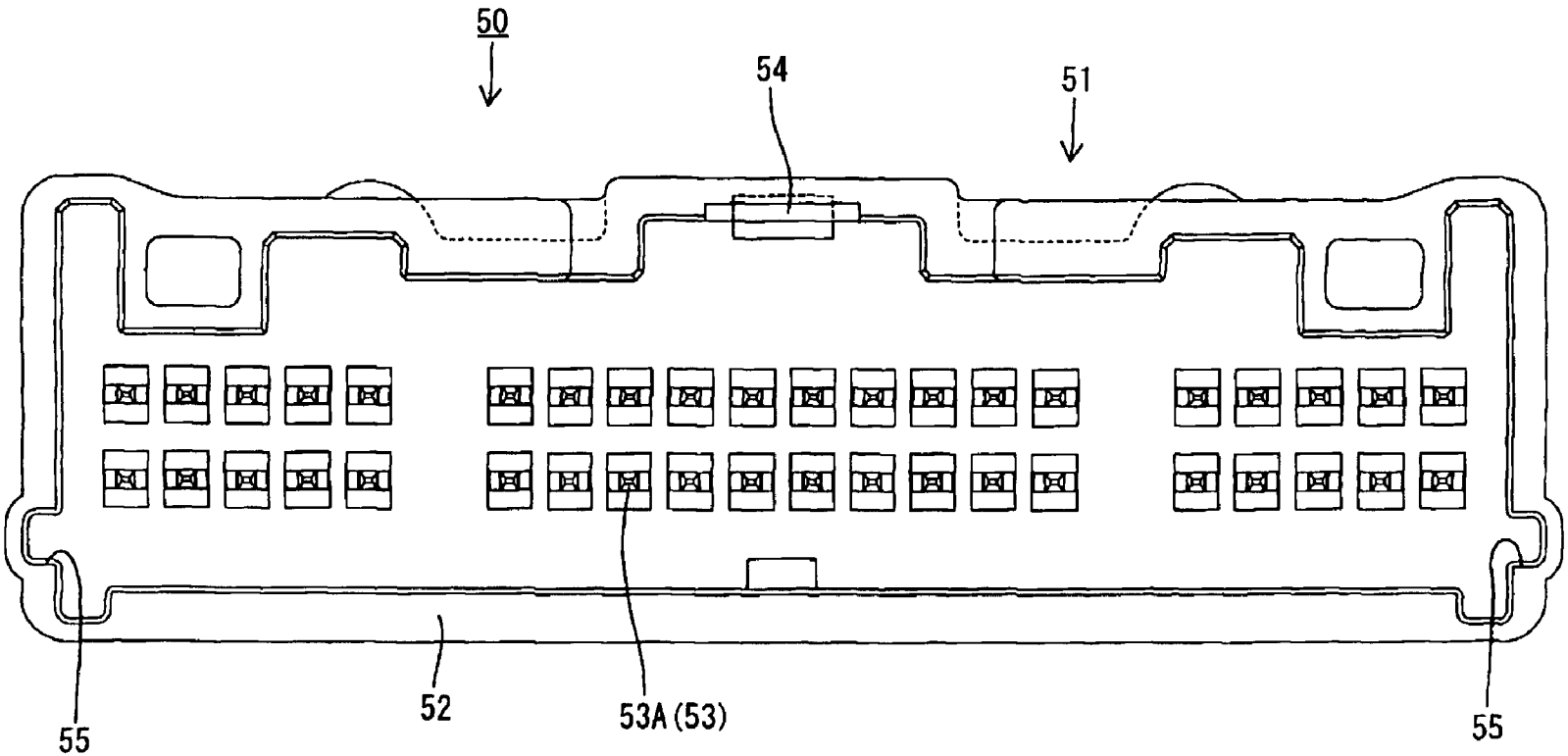
FIG. 12 is a front view of the male connector.

The male connector 50 includes a male housing 51 made e.g. of a synthetic resin as shown in FIGS. 7, 12 and 13. A fitting portion 52 in the form of a wide receptacle is provided on the front surface of the male housing 51, and the female connector 10 is fittable into the fitting portion 52. Male terminal fittings 53 are pressed into the back end surface of the fitting portion 52 at positions corresponding to the respective cavities 16, 32 of the female connector 10. Each male terminal fitting 53 includes a tab 53A projecting into the fitting portion 52. Projecting distances of the tabs 53A from the back end surface of the fitting portion 52 all are substantially equal. A receiving portion 54 is formed substantially in the transverse center of the ceiling of the fitting portion 52 and is engageable with the lock arm 21 of the housing main body 11 to lock the male and female housings 51, 11 in their properly connected state. Error connection preventing grooves 55 are formed along forward and backward directions FBD at lower parts of the opposite left and right inner surfaces of the fitting portion 52 for receiving the error connection preventing ribs 29, 44 of the housing main body 11 and the retainer 40. The error connection preventing ribs 29, 44 and the error connection preventing grooves 55 prevent upside-down insertion of the male connector 10.

The auxiliary connector 30 is assembled by inserting the female terminal fittings 31 into the corresponding cavities 32 and then closing the retainers 35 to doubly lock the female terminal fittings 31 (see FIG. 3).

The retainers 40 then are mounted at their partial locking positions 1P in the housing main body 11, and the auxiliary connector 30 is inserted along the inserting direction ID into the accommodating portion 12 from behind. An attempt may be made to insert the auxiliary connector 30 upside down. However, the error insertion preventing ribs 37 will catch the opening edge of the accommodating portion 12 to hinder the insertion and to detect the erroneous orientation. The guiding surfaces 38A of the locking projections 38 on the properly oriented auxiliary connector 30 contact the locks 26 as the insertion progresses and deform the locks 26 out in the direction ULD. The front wall 33 of the auxiliary connector 30 contacts the front wall 13 of the accommodating portion 12 when the auxiliary connector 30 is inserted to the proper mount position. At this time, the locking pieces 26 are restored resiliently inward and the locking surfaces 26A thereof engage the locking surfaces 38B of the locking projections 38. Thus, the auxiliary connector 30 is locked so as not to come out (see FIG. 9).

The female terminal fittings 15 subsequently are inserted into the corresponding cavities 16 of the housing main body 11, and each retainer 40 is pushed from the partial locking position 1P to the full locking position 2P. The retainer 40 could be pushed before the auxiliary connector 30 reaches the proper mount position. However, the detecting rib 43 of the retainer 40 contacts the error insertion preventing rib 37 in the error insertion preventing groove 23, as shown in FIG. 8(A). Accordingly, the retainer 40 cannot be pushed to the full locking position 2P and the insufficient insertion of the auxiliary connector 30 is detected. The retainer 40 can be pushed to the full locking position 2P when the auxiliary connector 30 is at the proper mount position. Thus, the detecting rib 43 enters the error insertion-preventing groove 23 without interfering with the error insertion preventing rib 37 of the auxiliary connector 30 (FIG. 8(B)). As a result, the retainer 40 reaches the full locking position 2P and doubly locks the female terminal fittings 15 in the cavities 16. Additionally, the detecting rib 43 engages the rear surface of the error insertion preventing rib 37 of the auxiliary connector 30 and doubly locks the auxiliary connector 30. In this way, assembly of the female connector 10 is completed.

Next, the male and female connectors 50, 10 are opposed to each other, as shown in FIGS. 1 and 13. The female connector 10 then is fit into the fitting portion 52 and the error connection preventing ribs 29 of the housing main body 11 enter the error connection preventing grooves 55 of the male housing 51. Here, the error connection preventing ribs 29 of the housing main body 11 and the error connection preventing ribs 44 of the retainers 40 align, if the retainers 40 are pushed properly to their full locking positions 2P. As a result, the error connection preventing ribs 29, 44 enter the error connection preventing grooves 55 of the male housing 51 to continue the fitting operation. On the other hand, a retainer 40 may be left at the partial locking position 1P. This may occur if it was forgotten to push the retainers 40 to the full locking positions 2P or if the retainers 40 cannot be pushed to the full locking positions 2P because the auxiliary connector 30 is inserted insufficiently. An attempt could be made to connect the male and female connectors 10, 50 in this state. However, the error connection preventing ribs 44 of the retainers 40 are displaced from the error connection preventing ribs 29 of the housing main body 11 and interfere with the opening edge of the fitting portion 52 to prevent further connection. In this way, the insufficient insertion of the retainers 40 is detected.

As the connection of the male and female connectors 50, 10 deepens, the tabs 53A of the male terminal fittings 53 enter the cavities 16, 32 through the tab insertion holes 17A of the front walls 17 or through the tab insertion holes 13A of the front wall 13 and the tab insertion holes 33A of the front walls 33. The female terminal fittings 31 in the auxiliary connector 30 are located behind the female terminal fittings 15 in the housing main body 11 by the dimension d. Thus, the tabs 53A having entered the cavities 16 of the housing main body 11 are inserted first into the female terminal fittings 15. Subsequently the tabs 53A, having entered the cavities 32 of the auxiliary connector 30, are inserted into the female terminal fittings 31. An insertion resistance Pa between the male and female terminal fittings 53, 15 suddenly increases to a peak value due to resilient restoring forces of the resilient contact pieces 15A immediately after the contact of the leading ends of the tabs 53A with the resilient contact pieces 15A. The insertion resistance Pa then decreases and the deformation of the resilient contact pieces 15A stops being held in sliding contact with the tabs 53A. Thus, the insertion resistance Pa becomes substantially stable at a low value (e.g. less than about ¾ of the peak value). An insertion resistance Pb between the female terminal fittings 31 in the auxiliary connector 30 and the tabs 53A shows a tendency similar to the insertion resistance Pa, but reaches its peak value later because the female terminal fittings 31 are displaced back from the female terminal fittings 15 by the distance d. An insertion resistance Pc between the tabs 53A and the corresponding female terminal fittings 15, 31 is a sum of the insertion resistance Pa between the female terminal fittings 15 and the tabs 53A and the insertion resistance Pb between the female terminal fittings 31 and the tabs 53A. A peak value thereof is lower than a peak value of an assumed insertion resistance Pd (about twofold of Pa) that would occur if the female terminal fittings 31 started contacting the tabs 53A at the same time as the female terminal fittings 15. Thus, a peak value of a connection resistance between the male and female connectors 50, 10 is reduced.

Figure 15:
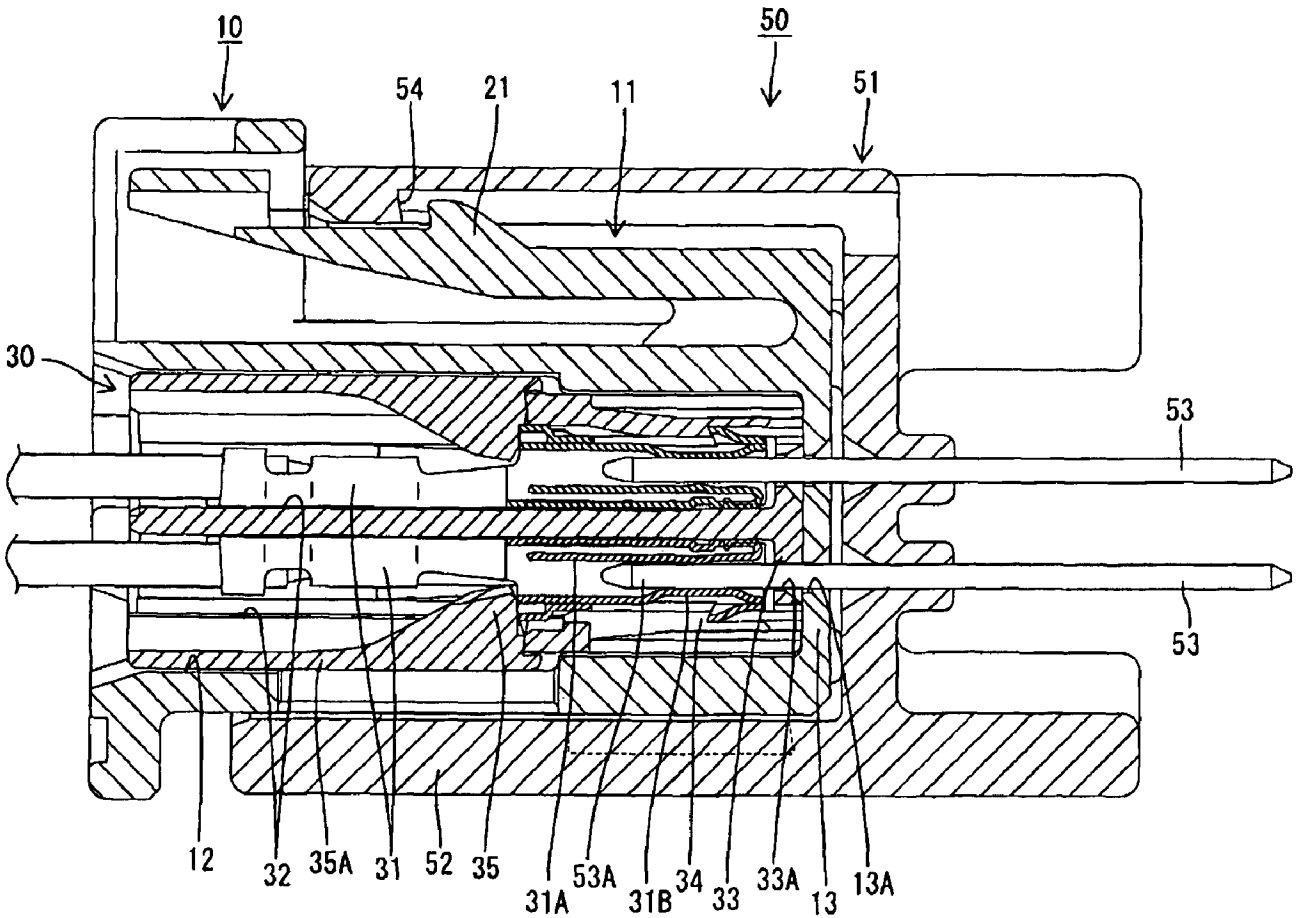
FIG. 15 is a side view in section showing a state where the male and female connectors are properly connected.

The female connector 10 is pushed to the back wall of the fitting portion 52. Thus, the lock arm 21 engages the receiving portion 54 to lock the housings 51, 11 in their properly connected state as shown in FIG. 15.

Figure 11B:
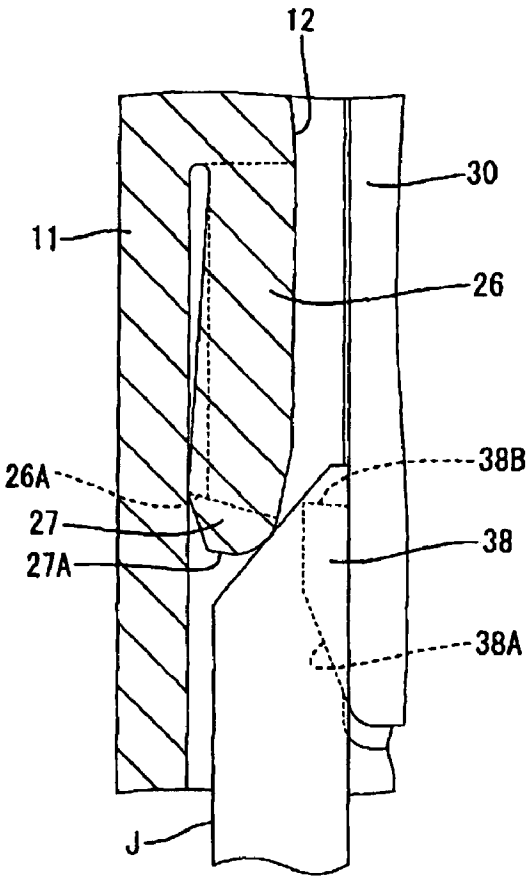
FIGS. 11(A) and 11(B) are partial enlarged plan views in section showing a state where the jig is in contact with a locking piece and a state where the locking piece is unlocked by the jig.
Figure 11A:
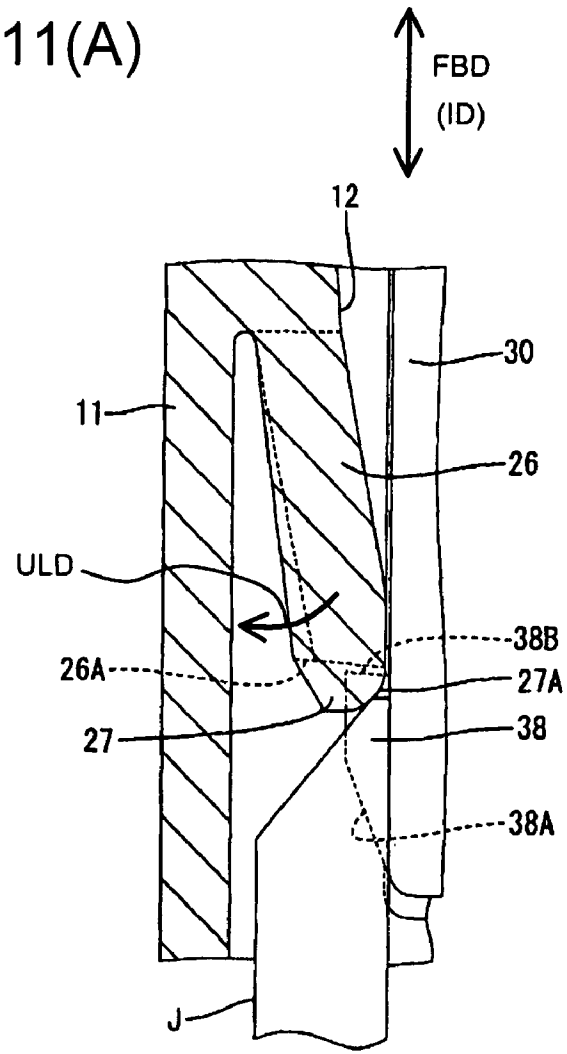

The auxiliary connector 30 may have to be detached from the housing main body 11 for maintenance or other reason. Thus, the retainers 40 are pushed from the full locking positions 2P to the partial locking positions 1P. Subsequently, as shown in FIGS. 9 and 10, the pointed end of a jig J is inserted into the unlocking window 28 of the housing main body 11. The leading end of the jig J is fit into the groove 39 between the upper and lower locking projections 38 and slides towards the back. The leading end of the jig J then enters the clearance between the guiding surface 27A of the disengaging projection 27 and the side surface of the auxiliary connector 30 to contact the introducing surface 27A, as shown in FIG. 11(A). Here, the jig J is guided by the groove 39 formed between the pair of locking projections 38 to a position to contact the disengaging projection 27. Thus, operability is good.

The jig J is pushed further towards the back. Thus, the locking piece 26 is guided by the introducing surface 27A of the disengaging projection 27 and deforms resiliently in the unlocking direction ULD towards a side away from the side surface of the auxiliary connector 30, as shown in FIG. 11(B). Thus, the locking surface 26A of the lock 26 and the locking surface 38B of the locking projection 38 disengage. The auxiliary connector 30 can be pulled back out of the accommodating portion 12 with respect to the housing main body 11 after the left and right locks 26 are disengaged.

As described above, assembly of the retainers 40 is prevented if the auxiliary connector 30 is inserted insufficiently due to interference of the auxiliary connector 30 with the retainers 40 in the process of mounting the retainers 40 to the restricting positions. Thus, insufficient insertion of the auxiliary connector 30 is detected. The retainers 40 are existing constructions. Thus, the insufficient insertion of the auxiliary connector 30 can be detected without increasing the number of parts.

The error insertion preventing ribs 37 of the auxiliary connector 30 interfere with the detecting ribs 43 of the retainers 40, if the auxiliary connector 30 is inserted insufficiently. Thus, the insufficient insertion of the auxiliary connector 30 can be detected. The error insertion preventing ribs 37 and the error connection preventing grooves 55 are existing constructions. Thus, it is not necessary to make a big design change.

The housing main body 11 and the retainers 40 have the error connection preventing ribs 29, 44 that fit in the respective error connection preventing grooves 55 of the mating fitting portion 52. The error connection preventing ribs 44 of the retainers 40 are displaced from the error connection preventing ribs 29 of the housing main body 11 when the retainers are not at the restricting positions and interfere with the mating fitting portion 52 as the connecting operation progresses. Thus, the connecting operation is prevented. In this way, retainers 40 that are not at the full locking positions 2P can be detected. This may occur, for example, if the retainers 40 were not pushed to the full locking positions 2P because the auxiliary connector 30 was inserted insufficiently.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

The invention is also similarly applicable to male connectors at least partly accommodating one or more male terminal fittings.

The invention is also applicable to divided connectors of hybrid type using a plurality of kinds of terminal fittings.

The invention is similarly applicable to connectors comprising two or more auxiliary housings accommodated in the housing main body and/or connectors with terminal fittings in the auxiliary connector but none in the housing main body.

What is claimed is:

1. A divided connector, comprising:

a housing main body (11) with an accommodating portion (12) and at least one cavity (16) for receiving at least one terminal fitting (15);

an auxiliary housing (30) with at least one cavity (32) for receiving at least one terminal fitting (31), the auxiliary housing (30) being fittable into the accommodating portion (12); and a retainer (40) to be mounted at a restricting position (2P) in the housing main body (11) to lock the terminal fittings (15) in the housing main body (11);

wherein, the auxiliary housing (30) is configured not to interfere with the retainer (40) and to permit the retainer (40) to be mounted at the restricting position (2P) when the auxiliary housing (30) is at a proper mount position in the housing main body (11) and wherein the auxiliary housing (30) is configured to interfere with the retainer (40) and to prevent the retainer (40) from being mounted to the restricting position (2P) when the auxiliary housing (30) is at a position displaced back from the proper mount position.

2. The divided connector of claim 1, wherein at least one error insertion preventing rib (37) is provided on an outer surface of the auxiliary housing (30) and at least one error insertion preventing groove (23) is formed in an inner surface of the accommodating portion (12) substantially along an inserting direction (ID) of the auxiliary connector housing (30) for receiving the error insertion preventing rib (37).

3. The divided connector of claim 2, wherein the retainer (40) has at least one detector (43) insertable into the error insertion preventing groove (23), and the error insertion preventing rib (29) being configured not to interfere with the detector (43) and to permit the retainer (40) to be mounted at the restricting position (2P) if the auxiliary housing (30) is at a proper mount position, the error insertion preventing rib (29) interfering with the detector (43) and preventing the retainer (40) from being mounted to the restricting position (2P) when the auxiliary housing (30) is at the position displaced back and away from the proper mount position.

4. The divided connector of claim 1, wherein:

the housing main body (11) and the retainer (40) are fittable into a fitting portion (52) of a mating connector (50); and an error connection preventing rib (44) being provided on one of an outer surface of the retainer (40) and the fitting portion (52) and a groove (55) being provided on the other of the outer surface of the retainer (40) and the fitting portion (52), the error connection preventing rib (44) and the groove (55) being configured for engagement with one another.

5. The divided connector of claim 4, wherein the error connection preventing ribs (44) are disposed to enter the groove (55) when the retainer (40) is at the restricting position (2P) in the housing main body (11), and the error connection preventing rib (44) being disposed to interfere with the fitting portion (52) and prevent a connecting operation when the retainer (40) is not located at the restricting position (2P).

6. The divided connector of claim 5, wherein the error connection preventing ribs (44) are provided on the housing main body (11) and on the retainer (40) and are aligned substantially along a connecting direction (FBD) and are fittable into the groove (55) in the fitting portion (52) when the retainer (40) is at the restricting position (2P) in the housing main body (11), and the error connection preventing rib (44) of the retainer (40) being displaced from the error connection preventing rib (44) of the housing main body (11) to interfere with the fitting portion (52) and prevent a connecting operation when the retainer (40) is not at the restricting position (2P).

7. The divided connector of claim 1, wherein the terminal fittings (31) mounted in the auxiliary connector (30) are spaced apart from the terminal fittings (15) mounted in the housing main body (11) by a distance (d) substantially along the connecting direction (FBD).

8. The divided connector of claim 1, wherein the retainer (40) is unitarily provided on the housing main body (11).

9. A divided connector, comprising:

a housing main body (11) with opposite front and rear ends, main cavities (16) extending forward into the rear end of the housing main body (11) for receiving main terminal fittings (15), a retainer mount hole (19) extending into the housing main body (11) and intersecting the main cavities (16), and an accommodating recess (12) extending forward into the rear end of the housing main body (11) and communicating with a portion of the retainer mount hole (19);

an auxiliary housing (30) with auxiliary cavities (32) for receiving auxiliary terminal fittings (31), the auxiliary housing (30) being fittable into the accommodating recess (12) and having an insertion preventing rib (37), the insertion preventing rib (37) being forward of the retainer mount hole (19) when the auxiliary housing (30) is in a proper mount position and projecting partly into the retainer mount hole (19) when the auxiliary housing (30) is rearward of the proper mount position; and a retainer (40) configured for mounting at a restricting position (2P) in the retainer mount hole (19) to lock the main terminal fittings (15) in the main cavities (16) of the housing main body (11), wherein the insertion preventing rib (37) of the auxiliary housing (30) prevents the retainer (40) from reaching restricting position (2P) when the auxiliary housing (30) is rearward of the proper mount position in the accommodating recess (12).

10. The divided connector of claim 9, wherein an error insertion preventing groove (23) extends along in an inner surface of the accommodating recess (12) substantially along an inserting direction (ID) of the auxiliary housing (30) for receiving the error insertion preventing rib (37).

11. The divided connector of claim 10, wherein the retainer (40) has a detector (43) insertable into the error insertion preventing groove (23).

12. The divided connector of claim 9, wherein:

the housing main body (11) and the retainer (40) are fittable into a fitting portion (52) of a mating connector (50); and an error connection preventing rib (44) being provided on an outer surface of the retainer (40) and a groove (55) being provided on an inner surface of the fitting portion (52), the error connection preventing rib (44) and the groove (55) being configured for engagement with one another when the retainer (40) is at the restricting position (2P) in the retainer mount hole (19), and the error connection preventing rib (44) being disposed to interfere with the fitting portion (52) and prevent a connecting operation when the retainer (40) is not located at the restricting position (2P).

* * * * *